United States Patent [19]

Toncelli

[11] Patent Number: 4,909,974

[45] Date of Patent: Mar. 20, 1990

[54] PROCESS FOR THE PREPARATION OF MULTILAYER BLOCKS SUITABLE FOR THE PRODUCTION OF SLABS WITHOUT THE USE OF A SAWING MACHINE

[76] Inventor: Luca Toncelli, Via Giovanni XXIII, 2—Bassano del Grappa (Vicenza), Italy

[21] Appl. No.: 172,198

[22] Filed: Mar. 23, 1988

[30] Foreign Application Priority Data

Mar. 31, 1987 [IT] Italy ..... 85524 A/87

[51] Int. Cl.[4] ..... B28B 1/08; B28B 1/16; B28B 3/06

[52] U.S. Cl. ..... 264/71; 264/256; 264/297.4; 264/297.7

[58] Field of Search ..... 156/62.2, 73.6, 245, 156/289; 264/69, 71, 72, 112, 113, 297.4, 297.9, 256; 249/82, 126, 128, 158; 425/448

[56] References Cited

U.S. PATENT DOCUMENTS

| | | | |
|---|---|---|---|
| 3,270,113 | 8/1966 | Longinotti | 264/256 |
| 4,067,941 | 1/1978 | Gaudelli | 264/297.4 |
| 4,151,246 | 4/1979 | Lester | 264/297.4 |
| 4,696,839 | 9/1987 | Renker | 264/71 |
| 4,698,010 | 10/1987 | Toncelli | 264/71 |

*Primary Examiner*—Marion C. McCamish
*Assistant Examiner*—J. Davis
*Attorney, Agent, or Firm*—Bucknam and Archer

[57] ABSTRACT

A process for the production of a multi-layer block by distribution of a mixture, the block being used for the production of agglomerated slabs of marble, granite, sand or in general stone, consists of weighing a predetermined amount of the mixture, mixing it to render it homogeneous, conveying the predetermined amount of homogeneous mixture into a mold provided with a vertically movable bottom, subjecting the mixture to a vibrating action by means of a vibrating plate, then lowering said predetermined amount of the mixture of a distance equal to the thickness of a new slab, covering the mixture with a sheet of impermeable material, repeating the operations until the mold is filled. A multi-layer block is formed, which is compacted and allowed to set. The block is separated into slabs corresponding to the sheets of impermeable material. The apparatus is also described.

5 Claims, 3 Drawing Sheets

PROCESS FOR THE PREPARATION OF MULTILAYER BLOCKS SUITABLE FOR THE PRODUCTION OF SLABS WITHOUT THE USE OF A SAWING MACHINE

The present invention relates to a process for the production of multi-layer blocks by distribution of a mixture in the interior of a mold, the mixture consisting of a granulate of marble, granite, sand or in general stones, or the same material in powder form, together with a binder, in the most suitable proportions. The block prepared in this manner is then subjected to one of various processes for the final shaping. The resulting block permits to obtain slabs of predetermined thickness without using any sawing machine.

According to the present state of the art, the mixture consists of granules of marble, granite or in general stone or powder of the same material, together with a binder such as a resin or cement. After the preparation in an atmospheric environment or under vacuum, the mixture is transferred into the interior of the mold or in the same die, is levelled with a suitable levelling machine and finally it is transferred to a forming apparatus. The article being obtained consists of slabs or blocks of any dimensions.

In the case of slabs, the production is very limited with respect to the production of the blocks due to the unfavorable ratio between the period of time of the cycle and the surface unit being obtained. In addition, if the slabs are prepared with cement as the binder, it is necessary to use a support plane for each slab, a fact which requires consequently substantial space for stage due to the fact that the slabs must be allowed to set. In addition, the blocks have the drawback that they must be transformed into slabs by means of a suitable sawing machine.

The object of the present invention is to avoid the drawbacks mentioned hereinabove and to permit to obtain in a cycle of formation, a multi-layer block consisting of a definite number of slabs of the desired thickness which could also vary, which block after it has set, permits to obtain the individual slabs without the necessity of using a sawing machine.

The invention is further illustrated by reference to the accompanying drawings of which:

The mixture previously prepared by means of any known apparatus consists in general of a mixture of granulate of marble, granite, sand or in general stone in pieces of definite dimensions as well as powder of the same materials together with a binder in the ratios and the quantities most suitable to make possible the subsequent formation into slabs.

Figure 1:
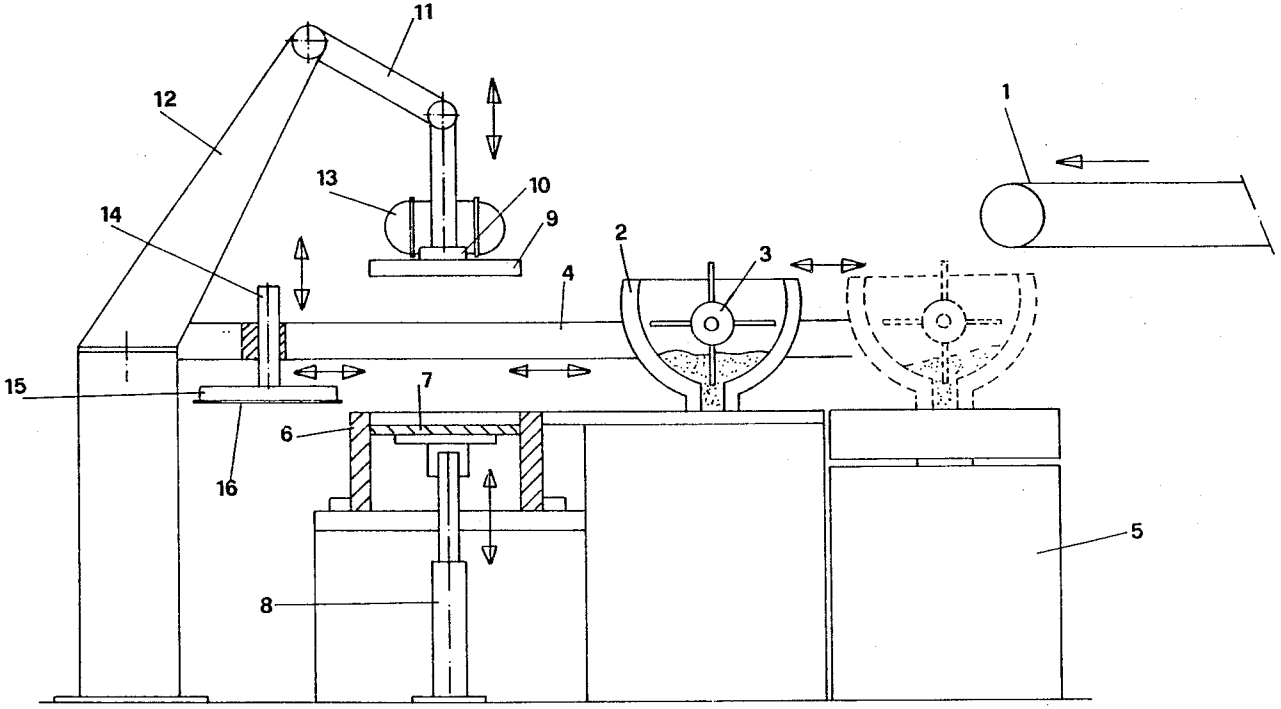
FIG. 1 is a schematic side view of the apparatus used to carry out the process of the present invention.

As shown in FIG. 1, the mixture is conveyed to the distributor 2 which permits to remove the quantity necessary to form a slab of the desired thickness. The conveyor 1 which carries the mixture from the mixing device to the appropriate apparatus is shown in FIG. 1.

The apparatus comprises distributor 2 which essentially consists of a vessel open at the bottom and provided with a rotor having blades 3 in the interior, the rotor with blades being placed in rotation by means of a suitable motor (not shown). The distributor 2 moves along horizontal guide 4 so that it goes over weighing device 5 and then is transferred to mold 6 where the mixture is distributed in the interior of the mold, the latter being provided with a movable bottom 7. The latter is supported and kept in position by the piston of cylinder 8. The cylinder 8 may be of the pneumatic or hydraulic type or may be replaced by equivalent mechanical means.

The vibrating plate 9 connected by means of articulated joint 10 to the control arm 11, the latter being connected by means of another articulated joint to the movable pennant shaped arm 12, supports vibrator 13. This vibrator exerts a vibrating force of determined intensity.

The apparatus also comprises a gripping device 14 which comprises plate 15 with openings capable of applying suction so that it is possible to grip a sheet of paper or other suitable material 16 capable of separating the mixtures intended to form the individual layers.

Figure 2:
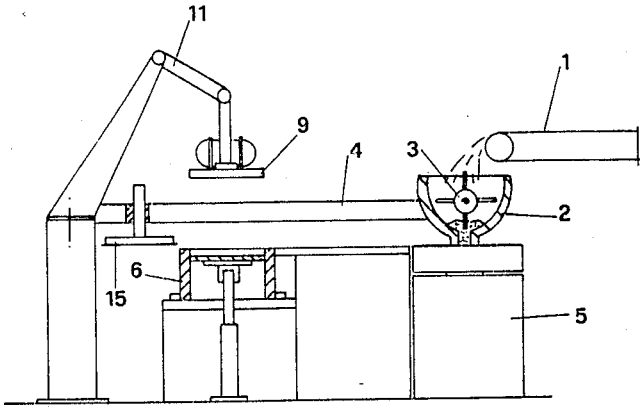
FIGS. 2, 3, 4, 5 and 6 illustrate the apparatus according to the successive phases of operation.

FIG. 2 illustrates the first phase of operation and shows that a suitable amount of the mixture preliminarily removed is transferred from the conveyor 1 into the distributor 2.

Figure 3:
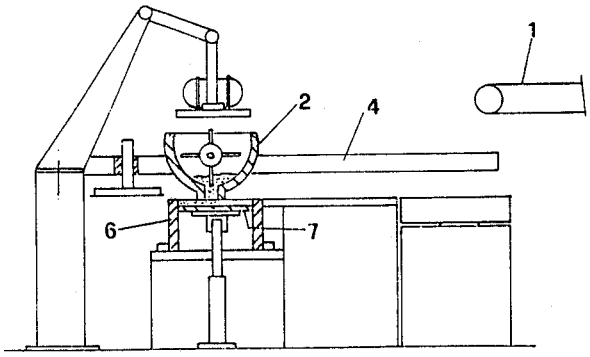

The distributor 2 in this phase rests on the weighing device 5 which permits to control accurately the quantity of the mixture being introduced in the same distributor. Immediately after, the distributor 2 which moves along guide 4 is brought in the position shown in FIG. 3, that is immediately above the mold 6. In this manner the mixture is uniformly distributed in the interior of mold 6, an operation which is promoted by the action of the rotor with blades 3 and the repeated passages which the first distributor 2 carries above the mold 6.

Figure 4:
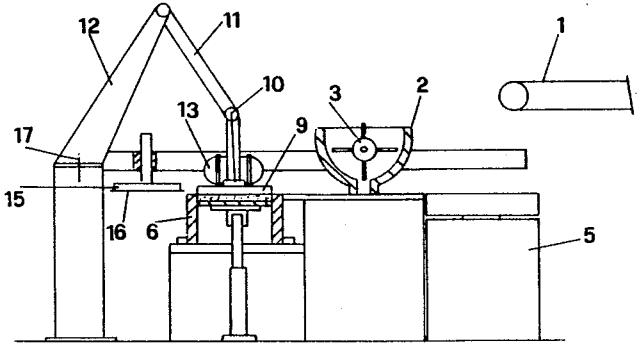

The mixture thus distributed in the interior of the mold 6 is subjected to vibrations by means of vibrating device 9 as shown in FIG. 4 which is placed on the mixture after the distributor 2 has moved to return towards the weighing device 5. The positioning of the vibrating plate 9 is carried out by means of arm 12 which rotating on its vertical axis 17 brings arm 11 in the position suitable to support the vibrating plate 9.

Figure 5:
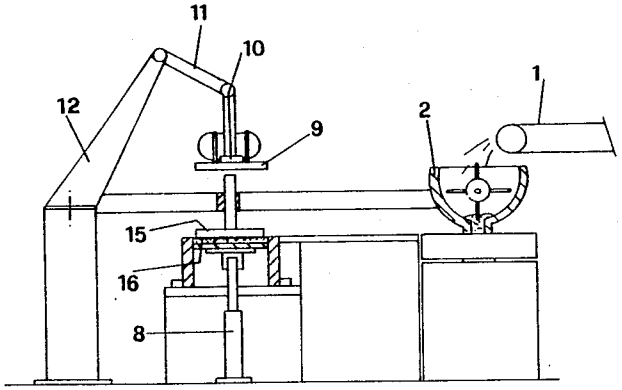

After plate 9 has been positioned above the mixture, vibrator 13 is activated. The vibrator exerts its vibrating force so as to render the distribution of the mixture along each transversal section homogeneous so as to eliminate every area of lack of homogeneity which might cause drawbacks in the subsequent compacting phase. After the vibrator 13 is deactivated, the movable bottom 7 is automatically lowered, acting on cylinder 8 of an amount equal to the thickness of the new slab which it is desired to obtain. The plate 9 follows the descent of the movable bottom 7 and carries with it the mixture which has been distributed and rendered homogeneous. After the movable bottom 7 is lowered, the arm 11 raises the plate 9, returning to the rest position. The manipulator 15 which had preliminarily drawn a sheet of paper 16 or a sheet of other material sufficiently strong and impermeable along both sides and of dimensions equal to the die, is lowered to return to a position above the mixture as shown in FIG. 5.

Figure 6:
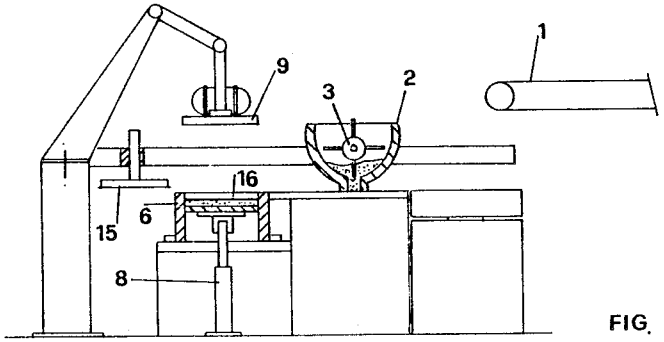

FIG. 6 shows the distributor 2 read to take a new dose of the mixture. The distributor 2 is shown in the position of returning towards the mold 6 where the mixture used in the preceding slab covered by the sheet of paper 16 has descended of an amount suitable to receive the mixture intended for the formation of a new slab. The vibrating plate 9 and the manipulator 15 are removed from the mold 6 and the cycle of operation starts again as previously described.

Therefore, the operations are repeated in a cycle up to a point of filling completely the mold 6. The mold 6 filled in this manner may be used in one of the apparatuses used for carrying out processes for the formation of slabs or blocks as described in Italian Patents Nos. 1,056,388; 1,117,346; 1,150,426 and Italian Patent Application No. 85632 A/84 or with any other device for the formation of slabs or blocks by compression, vibro-compression, press-work or vibration for production of decorative slabs for the building industry.

The multi-layer block obtained in this manner after formation and relative setting, is ready to be subdivided in slabs by means of every apparatus controlled manually or mechanically controlled which is placed between slab and slab corresponding to the sheet of separation of paper without using sawing machines. In this manner, it is possible to eliminate the period of time required for the sawing operation and even more important, it is not necessary to use sawing machines which are expensive and which involve high cost of operation and maintenance.

Even in the case of direct formation of the slabs, it is not necessary to use plates for the storage which require a substantial amount of space for the setting in addition to a high cost for the plates.

The invention is intended to extend to other apparatuses capable of carrying out the process as shown by way of example in the drawings. Obviously, the details of operation of the process and the apparatus illustrated in the drawings and described hereinabove may be changed according to the requirements of each operation while the essential features of the apparatus and the process remain the same.

What is claimed is:

1. The process for the production of a multi-layer block from a mixture of marble, stone, granite, sand, and the like, with a binder which consists of the steps of:

(1) conveying said mixture into a distributor, said distributor having a weighing device for weighing the amount of said mixture, (2) mixing said weighed mixture in said distributor to obtain an homogeneous mixture, (3) conveying said weighed homogeneous mixture into a mold provided with a vertically movable bottom, (4) subjecting said mixture to a vibrating action by means of a vibrating plate, (5) lowering said mixture a distance equal to the thickness of a single layer, (6) covering said layer with a sheet of impermeable material, and (7) repeating said steps (1)–(6) until said mold is filled, whereby a multi-layer block is formed with each layer covered by a sheet of impermeable material, compacting, allowing said block to set and separating said layers by removing the sheets of impermeable material.

2. The process according to claim 1 wherein said sheet of impermeable material is paper.

3. The process according to claim 1 wherein said mixture in step (3) is conveyed by said distributor to a location above the mold by means of a guide.

4. The process according to claim 3 wherein said guide moves back and forth, and the distributor is returned to its initial position during step (4).

5. The process according to claim 1 wherein said vibrating plate is lowered during step (4) and is then raised prior to step (6).

* * * * *